US007690346B2

(12) United States Patent
Edamatsu et al.

(10) Patent No.: US 7,690,346 B2
(45) Date of Patent: Apr. 6, 2010

(54) CARBURETOR MOUNTING STRUCTURE

(75) Inventors: Shigeki Edamatsu, Saitama (JP); Yasunori Matsubara, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 71 days.

(21) Appl. No.: 11/958,992

(22) Filed: Dec. 18, 2007

(65) Prior Publication Data

US 2008/0164696 A1 Jul. 10, 2008

(30) Foreign Application Priority Data

Dec. 22, 2006 (JP) ..... 2006-346626

(51) Int. Cl.
*F02M 17/34* (2006.01)

(52) U.S. Cl. ..... 123/184.21; 261/36.2

(58) Field of Classification Search .....
123/184.21–184.61, 54.4; 261/36.2, 42, 261/65; 285/368, 414
See application file for complete search history.

(56) References Cited

U.S. PATENT DOCUMENTS 1,614,664 A * 1/1927 Dyer ..... 48/189.5
4,279,224 A * 7/1981 Szabo et al. ..... 123/184.32
5,813,384 A * 9/1998 Lavender et al. ..... 123/198 E

FOREIGN PATENT DOCUMENTS

JP 59-40554 U 3/1984
JP 59-40555 3/1984
JP 3-118266 U 12/1991

* cited by examiner

*Primary Examiner*—M. McMahon
(74) *Attorney, Agent, or Firm*—Arent Fox LLP

(57) ABSTRACT

In a carburetor mounting structure, a stud bolt is implanted in a carburetor mounting portion, a screw hole is provided in the carburetor mounting portion, first and second mounting flanges include first bolt holes through which the stud bolt passes, and second bolt holes into which a tap bolt is screwed, and the first bolt hole of the first mounting flange is formed into a notched shape so as to allow the stud bolt to be inserted into the first bolt hole from an outside of the first mounting flange. Thus, it is possible to provide a carburetor mounting structure wherein mounting of a carburetor by a stud bolt is possible even if only a small space exists outward of an outer end of the stud bolt.

3 Claims, 10 Drawing Sheets

CARBURETOR MOUNTING STRUCTURE

BACKGROUND OF THE INVENTION

1. Field of the Invention

The present invention relates to an improvement of a carburetor mounting structure comprising: a first mounting flange and a second mounting flange which are formed at a downstream end and an upstream end of a carburetor, respectively; and a plurality of bolts which pass through the first mounting flange and the second mounting flange and which are fastened to secure them to a carburetor mounting portion of an engine.

2. Description of the Related Art

In such a conventional carburetor mounting structure, as disclosed in, for example, Japanese Utility Model Application Laid-open No. 59-40555, a carburetor is mounted to a carburetor mounting portion as follows: bolt holes provided in a mounting flange of the carburetor are fitted to a plurality of stud bolts which are implanted in advance in the carburetor mounting portion of an engine; and nuts are screwed and fastened to the outer ends of the stud bolts.

In the above-described conventional structure, in the mounting of the carburetor, the carburetor can be temporarily fixed by first fitting the bolt holes in the mounting flanges of the carburetor to the stud bolts of the carburetor mounting portion. Therefore, the subsequent operation of screwing the nuts to the stud bolts is facilitated, leading to an advantage of excellent mountability of the carburetor.

However, in the above-described structure, when the bolt holes in the mounting flanges of the carburetor are fitted to the stud bolts of the carburetor mounting portion, the carburetor needs to be moved outward of the outer ends of the stud bolts. Therefore, if a space large enough to receive the entire carburetor does not exist outward of the outer ends of the stud bolts, it is impossible to use the above-described structure.

SUMMARY OF THE INVENTION

The present invention has been achieved in view of the above circumstances, and has an object to provide a carburetor mounting structure wherein mounting of a carburetor by a stud bolt is possible even if only a small space exists outward of an outer end of the stud bolt.

To achieve the above object, according to a first aspect of the present invention, there is provided a carburetor mounting structure comprising: a first mounting flange and a second mounting flange which are formed at a downstream end and an upstream end of a carburetor, respectively; and a plurality of bolts which pass through the first mounting flange and the second mounting flange and which are fastened to secure them to a carburetor mounting portion of an engine, wherein a stud bolt of said plurality of bolts is implanted in the carburetor mounting portion, and a screw hole is provided in the carburetor mounting portion; wherein the first and second mounting flanges include first bolt holes through which the stud bolt passes, and second bolt holes into which a tap bolt of said plurality of bolts is screwed; and wherein the first bolt hole of the first mounting flange is formed into a notched shape so as to allow the stud bolt to be inserted into the first bolt hole from an outside of the first mounting flange.

With the first feature of the present invention, the notch-shaped first bolt hole of the first mounting flange of the carburetor is engaged with the stud bolt from its side, and then the first bolt hole in the second mounting flange is fitted to the stud bolt while the entire carburetor is moved toward the carburetor mounting portion. Therefore, it is possible to quickly set the carburetor in a predetermined position of the stud bolt. Also, it is possible to temporarily fix the carburetor even if a space large enough to receive the entire carburetor does not exist outward of the outer end of the stud bolt.

Further, by use of the tap bolt in combination, the carburetor can be properly fixed in the fixed position without being influenced by the existence of the notched first bolt holes. Furthermore, the first and second mounting flanges which are formed at the downstream and upstream ends of the carburetor are fastened to the carburetor mounting portion by the stud bolt and the tap bolt, thereby enhancing a mounting strength of the carburetor.

According to a second feature of the present invention, in addition to the first feature, at least two stud bolts are disposed on one side portions of the first and second mounting flanges.

With the second feature of the present invention, the first bolt holes in the carburetor are fitted to the two stud bolts, thereby providing a reliable temporary fixed state wherein the rotation of the carburetor around the stud bolt is inhibited. Therefore, the subsequent operation of inserting the tap bolt into the second bolt holes, and operation of screwing the tap bolt into the screw holes are facilitated.

According to a third feature of the present invention, in addition to the first feature, the engine is of a V-type engine comprising a common crankcase, and first and second banks which respectively have cylinder bores 3*a*, 3*a* and which are connected to the common crankcase; a common flange serving as the carburetor mounting portion is formed at an upstream end of an intake manifold which is connected to the first and second banks so that the common flange faces a valley portion defined between the first and second banks; and the carburetor is housed in the valley portion and is fastened to the common flange by the stud bolt and the tap bolt.

With the third feature of the present invention, the carburetor can be easily and firmly mounted to the upstream end of the intake manifold even in a small valley portion defined between the first and second banks of the V-type engine, thereby contributing to reduction in the size of the V-type engine.

The above-mentioned object, other objects, characteristics, and advantages of the present invention will become apparent from preferred embodiments, which will be described in detail below by reference to the attached drawings.

DESCRIPTION OF THE PREFERRED EMBODIMENTS

Figure 1:
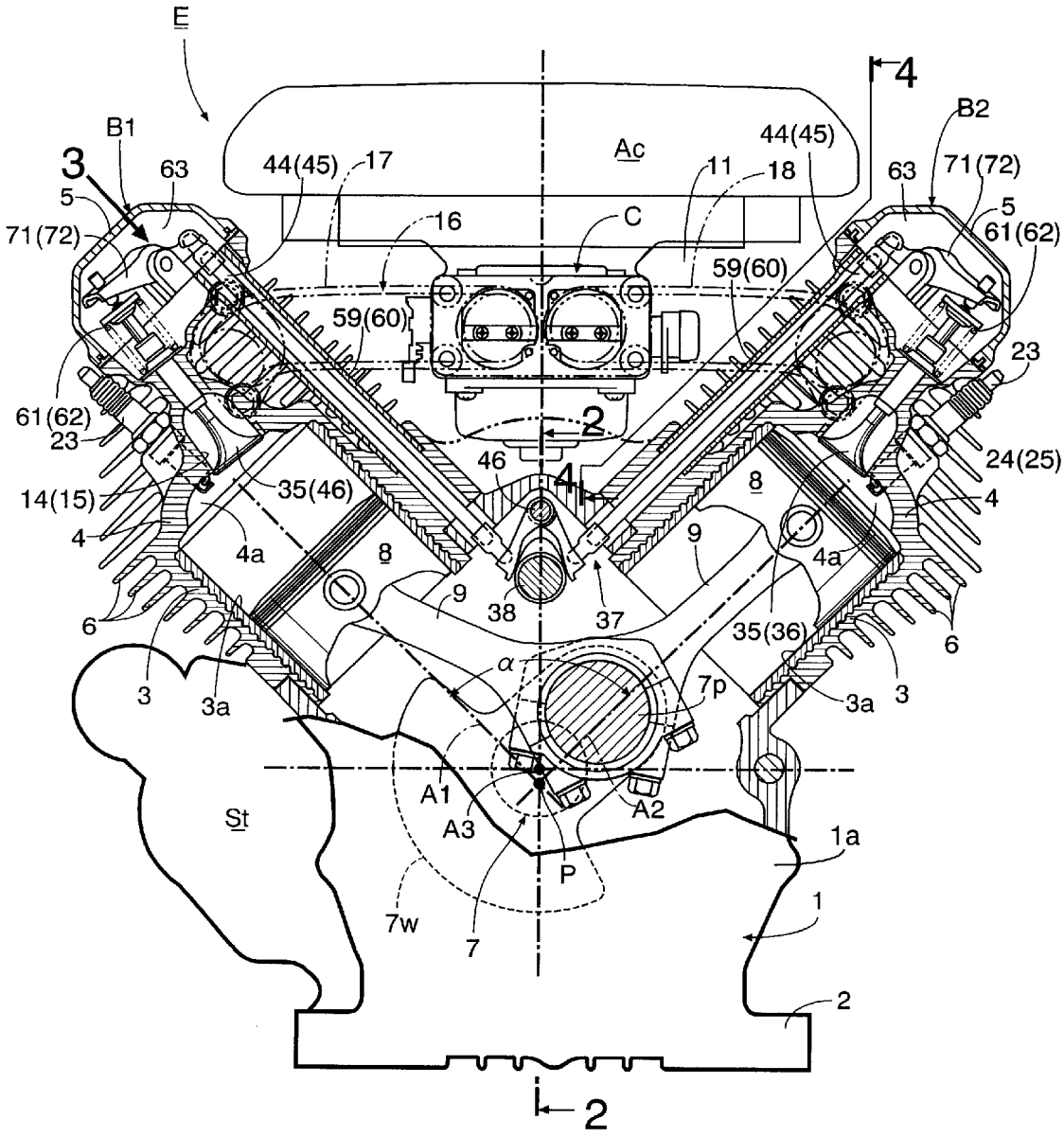
FIG. 1 is a vertical sectional front view of an air-cooling general-purpose V-type engine according to the present invention.
Figure 2:
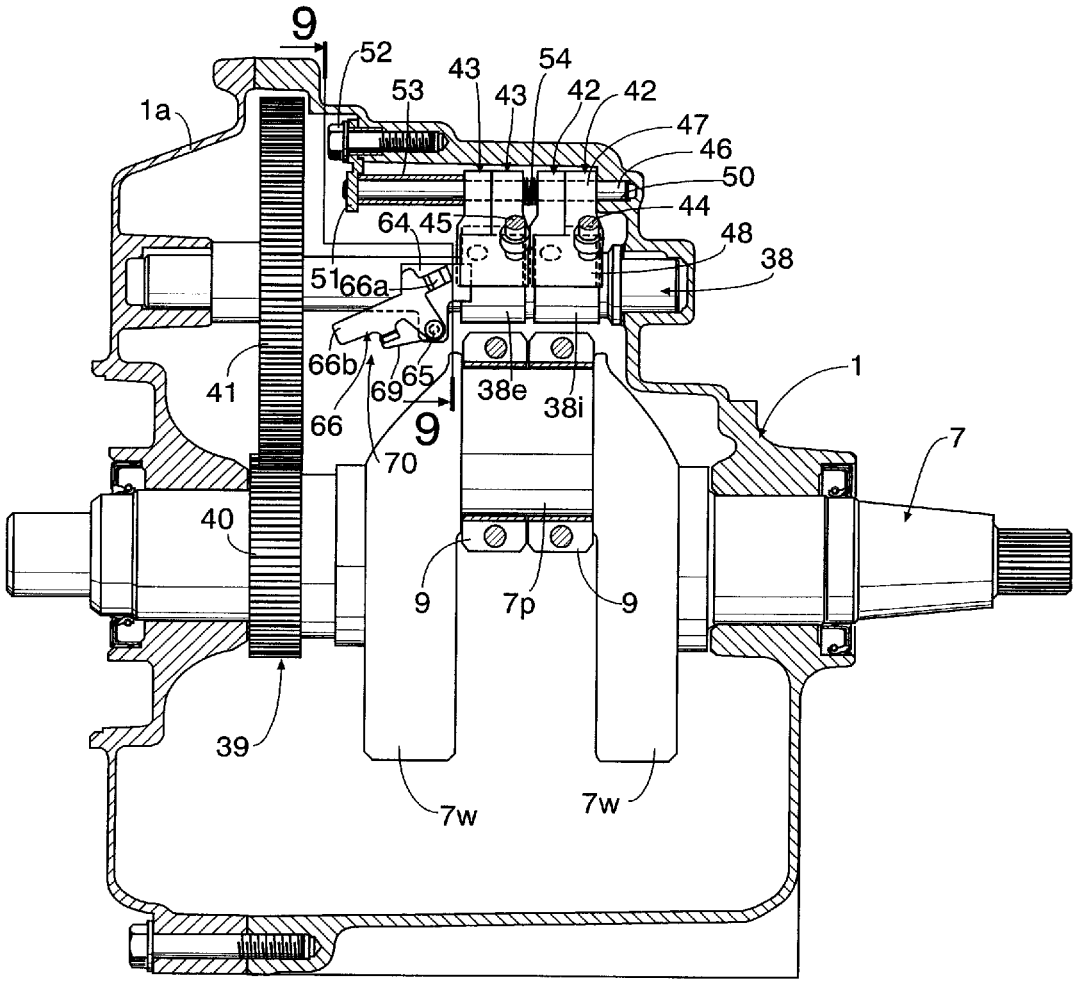
FIG. 2 is a sectional view taken along line 2-2 in FIG. 1.
Figure 3:
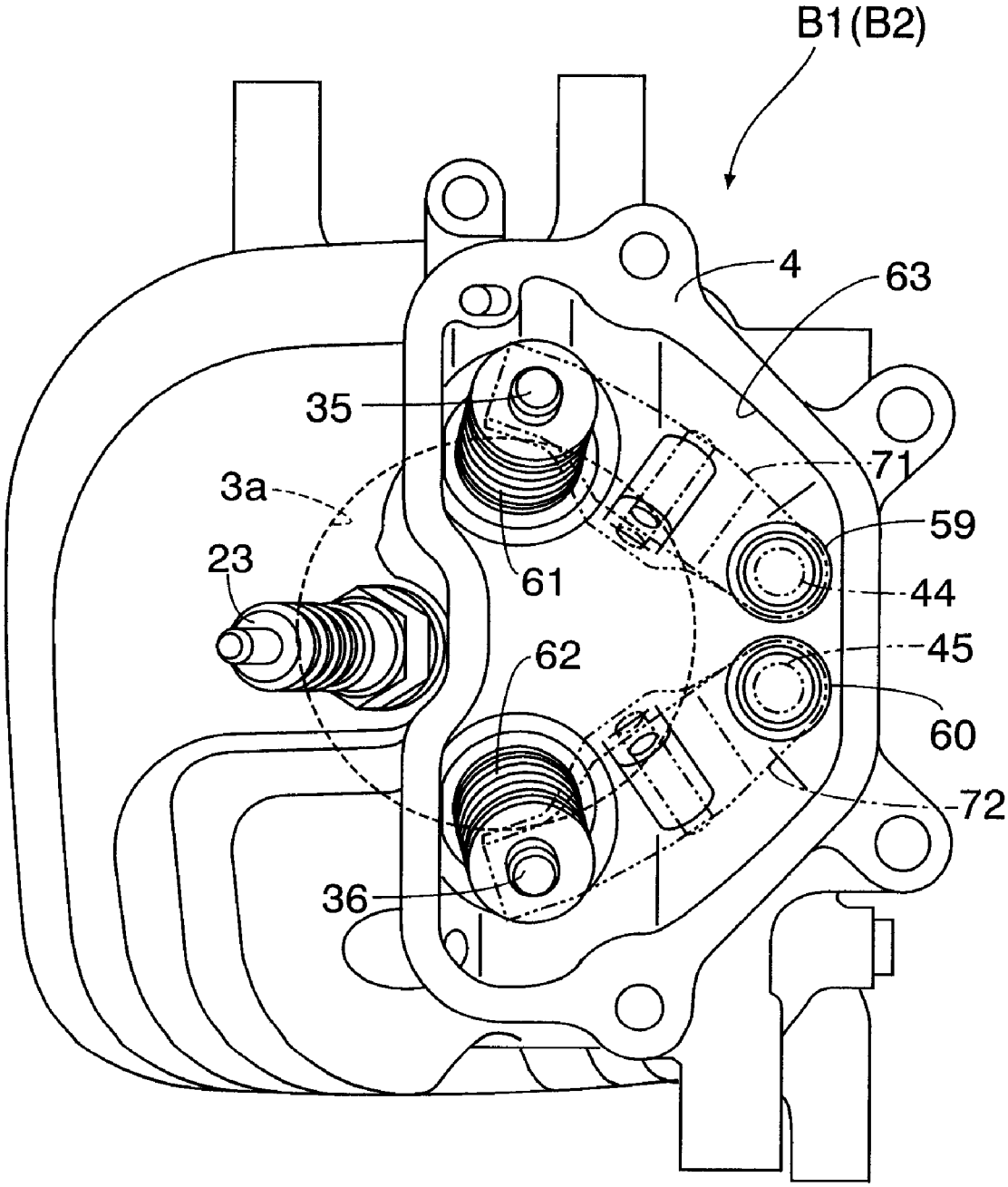
FIG. 3 is a view taken in the direction of arrow 3 in FIG. 1.

First, FIGS. 1 to 3 show an air-cooling general-purpose V-type engine which comprises: a crankcase 1; a first bank B1 and a second bank B2 are arranged in a V shape and connected to an upper portion of the crankcase 1; an installation flange 2 formed in a bottom portion of the crankcase 1; and a starter St provided on one side portion of the crankcase 1 so as to be housed in a space below the first bank B1.

Each of the first bank B1 and the second bank B2 comprises: a cylinder block 3 having a cylinder bore 3*a* and connected to the crankcase 1 by a bolt; a cylinder head 4 which has a valve chamber 4*a* leading to the cylinder bore 3*a* and which is integrally connected to the cylinder block 3; and a head cover 5 connected to an end surface of the cylinder head 4 by a bolt. A plurality of air-cooling fins 6 are integrally projectingly provided on outer surfaces of the cylinder block 3 and the cylinder head 4.

A single crankshaft 7 is supported in longitudinally opposite end walls of the crankcase 1. Pistons 8, 8 are connected to a crank pin 7*p* of the crankshaft 7 via connecting rods 9, 9 so as to be fitted in the cylinder bores 3*a*, 3*a* of the first and second banks B1 and B2. One of the longitudinally end wall 1*a* of the crankcase 1 is detachably attached to a main body of the crankcase 1, while enabling support of one end of the crankshaft 7.

The first and second banks B1 and B2 are disposed so that an opening angle α between the banks B1 and B2, that is, an angle α which is formed by a cylinder center line A1 of the first bank B1 and a cylinder center line A2 of the second bank B2 becomes 90°. Meanwhile, counterweights 7*w* are attached to the crankshaft 7 on a side opposite from the crank pin 7*p* so as to balance inertia forces of the pistons 8 of the banks B1 and B2.

Figure 6:
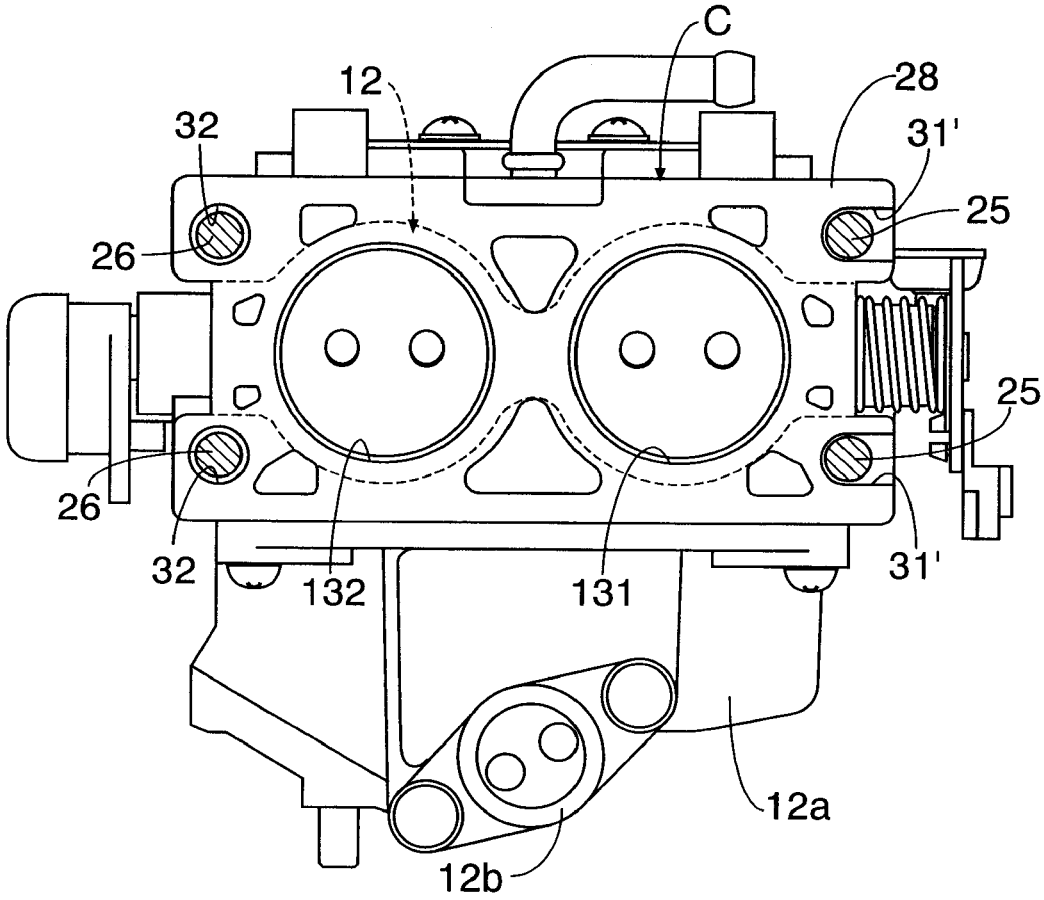
FIG. 6 is a sectional view taken along line 6-6 in FIG. 4.

The first and second banks B1 and B2 are disposed so that the cylinder center line A1 of the first bank B1 and the cylinder center line A2 of the second bank B2 pass through a point P which is eccentric from a rotational center A3 of the crankshaft 7 to the side opposite from both the banks B1 and B2. With this arrangement, a valley portion 11 defined between the first and second banks B1 and B2 can be made large while maintaining the opening angle α of the banks B1 and B2 at 90°. The valley portion 11 houses an entire carburetor C which is one auxiliary machine of an engine E, and a part of an air cleaner Ac containing a cleaner element 10. As clearly shown in FIG. 6, the carburetor C is of a twin type comprising: a carburetor main body 12; and horizontal (in a direction orthogonal to the crankshaft 7) first and second intake paths 131 and 132 which are disposed in the carburetor main body 12 in a direction of arrangement of the first and second banks B1 and B2. A float chamber 12*a* and a fuel-cutting electromagnetic valve 12*b* are mounted to a lower portion of the carburetor main body 12.

Figure 4:
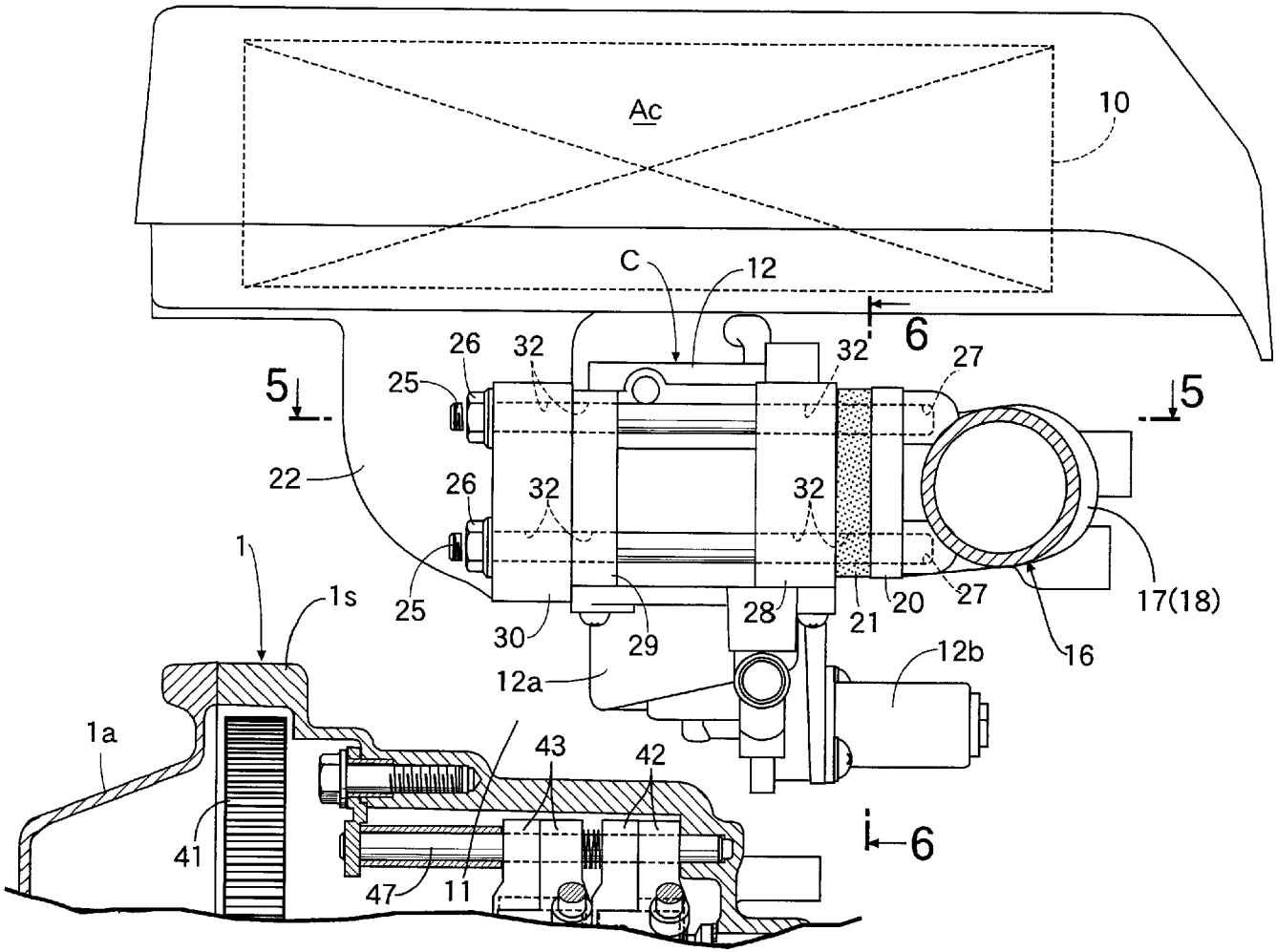
FIG. 4 is a sectional view taken along line 4-4 in FIG. 1.
Figure 5:
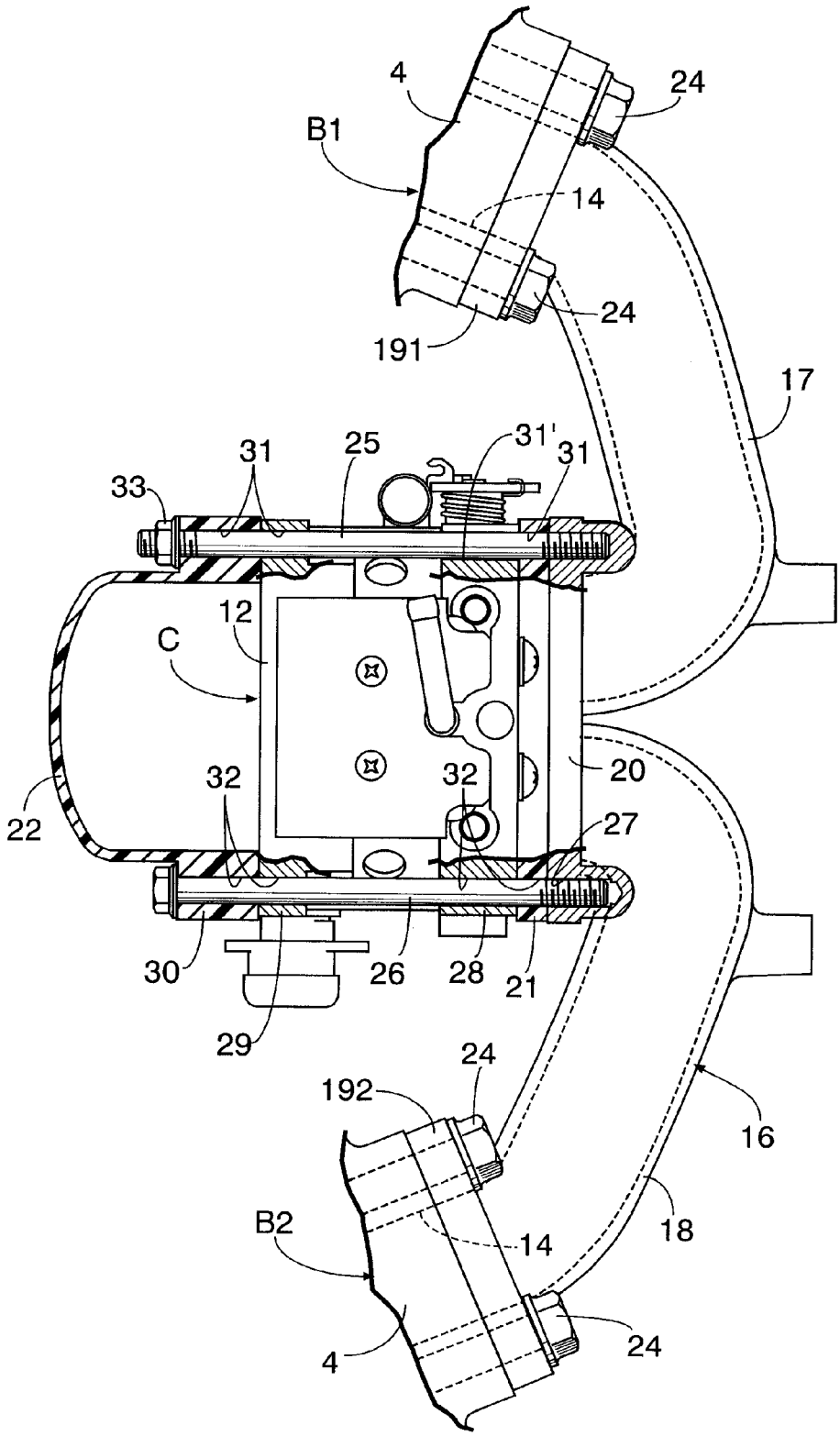
FIG. 5 is a sectional view taken along line 5-5 in FIG. 4.

As shown in FIGS. 1, 4 and 5, each cylinder head 4 of the first and second banks B1 and B2 includes an intake port 14 and an exhaust port 15 which are opened to a valve chamber 4*a*. The first and the second intake paths 131 and 132 are connected to the intake ports 14 and 14 of the first and second banks B1 and B2 via an intake manifold 16.

More specifically, the intake manifold 16 includes first and second conduit paths 17 and 18 which are bent outwards sideways of the valley portion 11 into a U-shape on the horizontal plane, and communicates the intake ports 14 and 14 of the first and second banks B1 and B2 with the first and second intake paths 131 and 132. Flanges 191 and 192 are individually formed at the downstream ends of the first and second conduit paths 17 and 18. A common flange 20 is formed at the upstream ends of the first and second conduit paths 17 and 18 so as to integrally connect them to each other. The individual flanges 191 and 192 are connected to the first and second cylinder heads 4 and 4 by bolts 24 and 24, respectively. A thermal insulating plate 21, first and second mounting flanges 28 and 29 which are formed respectively at the downstream end and the upstream end of the carburetor C, a mounting flange 30 which is formed at an outer periphery of an elbow-shaped air outlet pipe 22 in the air cleaner Ac, are jointly fastened to the common flange 20 by a plurality of bolts.

Next, the jointly fastening structure will be described based on FIGS. 4 to 8.

The above-described jointly fastening structure uses two stud bolts 25 and 25 and two tap bolts 26 and 26. The two stud bolts 25 and 25 are implanted in upper and lower spots in one side portion of the common flange 20 of the intake manifold 16. A pair of upper and lower screw holes 27 and 27 are provided in the other side portion of the common flange 20 so that the two tap bolts 26 and 26 can be screwed thereinto. Also, first bolt holes 31, 31, 31', 31' through which the two stud bolts 25 and 25 pass as well as second bolt holes 32 and 32 through which the two tap bolts 26 and 26 pass are provided in the first and second mounting flanges 28 and 29 of the thermally insulating plate 21 and the carburetor C as well as the mounting flange 30 of the air cleaner Ac. Particularly, each of the first bolt holes 31' and 31' of the first mounting flange 28 of the carburetor C is formed into a notched shape opened outwards sideways of the flange 28.

Gaskets are interposed in front and rear of the thermally insulating plate 21, if necessary.

As shown in FIGS. 1 and 3, an intake valve 20 and an exhaust valve 21 are provided in each cylinder head 4 so as to open and close the intake port 14 and the exhaust port 15, respectively. A valve-operating device 37 for opening and closing the intake and exhaust valves 20 and 21 is provided in a region extending from the crankcase 1 to the cylinder head 4. An ignition plug 23 is screwed into each cylinder head 4 such that its electrode faces the central portion of the valve chamber 4*a*.

Next, the valve-operating device 37 will be described based on FIGS. 1 to 3 and 9.

The valve-operating device 37 includes: a camshaft 38 which is supported in longitudinally opposite end walls of the crankcase 1 directly above the crankshaft 7 so as to be parallel with the crankshaft 7; and a timing transmission 39 which reduces the rotational speed of the crankshaft 7 by one half and transmits it to the camshaft 38. The timing transmission 39 includes: a driven timing gear 40 which is fixed to the crankshaft 7 at a position adjacent to the inner surface of the attachable/detachable end wall 1*a* of the crankcase 1; and a follower timing gear 41 which is fixed to the camshaft 38 and meshed with the driven timing gear 40.

An intake cam 38*i* and an exhaust cam 38*e* are integrally formed on the camshaft 38. The intake cam 38*i* is connected to intake valves 35 and 35 of the first and second banks B1 and B2, respectively, via a pair of intake cam followers 42 and 42, intake push rods 44 and 44, and intake rocker arms 71 and 71. The exhaust cam 38*e* is connected to exhaust valves 36 and 36 of the first and second banks B1 and B2, respectively, via a pair of exhaust cam followers 43 and 43, exhaust push rods 45 and 45 and exhaust rocker arms 72 and 72.

The respective pairs of intake cam followers 42 and 42 and exhaust cam followers 43 and 43 include: boss portions 47 swingably supported by a single cam follower shaft 46 which is mounted to the crankcase 1 directly above the camshaft 38 so as to be parallel with the camshaft 38; and slipper portions 48 which slide in contact with the corresponding cams 38*i* and 38*e*. In the pair of intake cam followers 42 and 42, their boss portions 47 and 47 are adjacent to each other on the cam follower shaft 46, and their slippers 48 and 48 are opposed to each other with the intake cam 38*i* therebetween. Also in the exhaust cam followers 43 and 43, their boss portions 47 and 47 are adjacent to each other on the cam follower shaft 46, and their slippers 48 and 48 are opposed to face each other with the exhaust cam 38*e* therebetween.

As shown in FIG. 2, one end of the cam follower shaft 46 is supported by a support hole 50 in the crankcase 1, and the other end thereof is supported by a bracket 51 which is fixed to the crankcase 1 by a bolt 52. The cam follower shaft 46 is provided with a distance collar 53 which abuts on the outer end surface of the boss portion 47 of the exhaust cam follower 43, and a coil spring 54 which is interposed between the boss portions 47 and 47 of the intake cam followers 42 and 42 and the exhaust cam followers 43 and 43. With these distance collar 53 and the coil spring 54, the intake cam followers 42 and 42 and the exhaust cam followers 43 and 43 are held at fixed positions on the cam follower shaft 46.

Semispherical engaging recesses 55 are formed on rear surfaces of the intake cam followers 42 and 42 and the exhaust cam followers 43 and 43. The semispherical lower ends of the intake push rods 44 and 44 are engaged with the engaging recesses 55 and 55 of the intake cam followers 42 and 42. The semispherical lower ends of the exhaust push rods 45 and 45 are engaged with the engaging recesses 55 and 55 of the exhaust cam followers 43 and 43.

As shown in FIGS. 1 and 3, in each of the banks B1 and B2, the intake and exhaust push rods 44 and 45 are housed in a pair of guide pipes 59 and 60 which are adjacent to the outer side surface of the cylinder block 3 on the side of the valley portion 11 and provides connection between the bottom wall of the cylinder head 4 and the ceiling wall of the crankcase 1.

Also, in each of the banks B1 and B2, intake and exhaust rocker arms 71 and 72 are swingably supported by the cylinder head 4. Valve springs 61 and 62 are fitted to the intake and exhaust valves 35 and 36 so as to urge them in the valve closing direction. These valve springs 61 and 62 and the intake and exhaust rocker arms 71 and 72 are housed in a valve-operating chamber 63 defined between the cylinder head 4 and the head cover 5.

As shown in FIG. 2, the camshaft 38 has a flat portion 64 which is formed in a region extending from a general surface of the camshaft 38 to a base surface of the exhaust cam 38*e*. A decompressing member 66 is swingably supported on the flat portion 64 via a pivot 65. The decompressing member 66 is made of a steel plate, and comprises: a decompressing arm 66*a* which is located on the base surface side of the exhaust cam 38*e* and has a tip end which projects from the base surface at the time of stopping and starting the engine E; and a centrifugal weight 66*b* which generates a centrifugal force for retreating the decompressing arm 66*a* from the base surface when the engine is rotated at a rotational speed higher than that in idling of the engine E. A return spring 69 for urging the decompressing arm 66*a* in the direction to retreat from the base surface is connected to the decompressing member 66. Therefore, a decompressing device 70 is constituted by these components described above.

Figure 9:
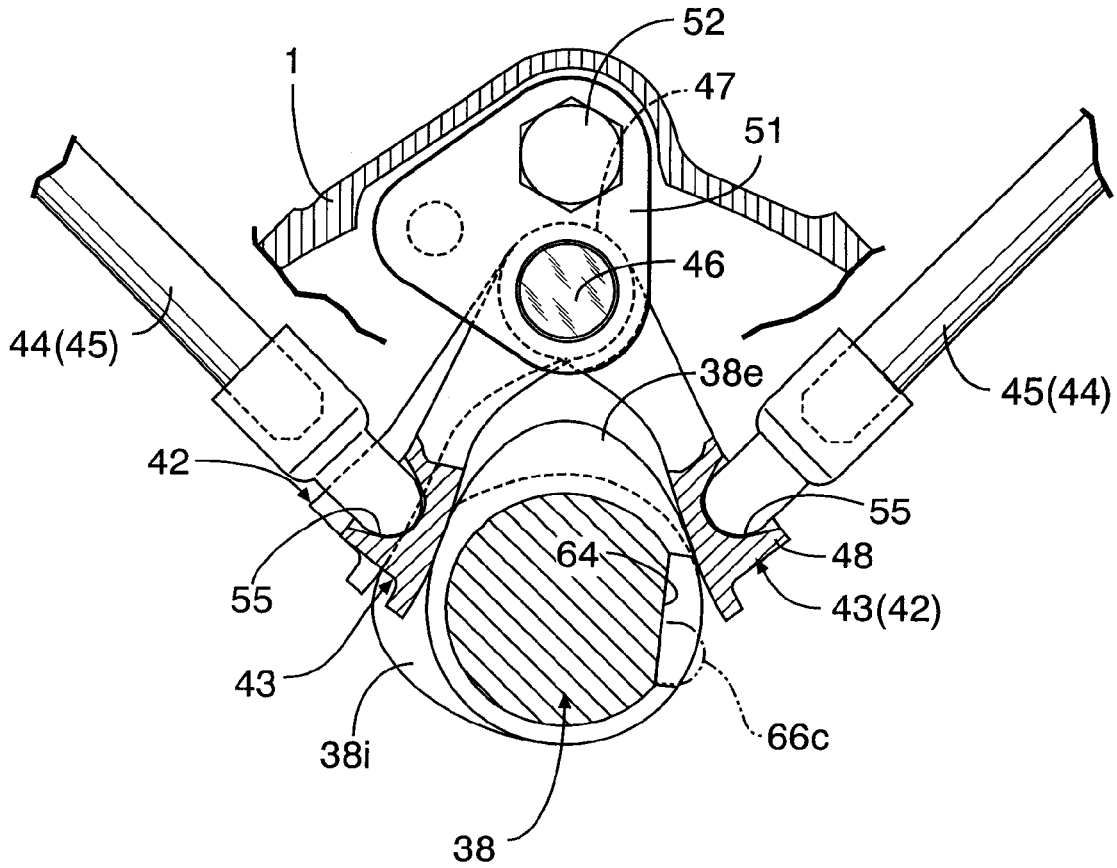
FIG. 9 is an enlarged sectional view taken along line 9-9 in FIG. 2.

Thus, at the time of start of the engine E, the decompressing arm 66*a* occupies the position where its tip end projects from the base surface of the exhaust cam 38*e* (see the chain line in FIG. 9). Therefore, also in the compression stroke, the exhaust cam followers 43 and 43 are very slightly lifted by the decompressing arm 66*a* to slightly open the exhaust valves 36 and 36 of the first and second banks B1 and B2, thereby lowering the compression pressure in the cylinder bores 3*a* and 3*a* to alleviate the starting load. After the engine E is started, when the cam shaft 38 is rotated at a predetermined rotational speed or more, the centrifugal weight 66*b* swings outward in the radial direction against the set load of the return spring 69 due to the centrifugal force acting on the centrifugal weight 66*b*, whereby the decompressing arm 66*a* is retreated from the base surface of the exhaust cam 38*e*.

Next, the operation of the embodiment will be described.

As described above, the first and second banks B1 and B2 are disposed so that the opening angle $\alpha$ between the banks B1 and B2 becomes 90°, and the counterweights 7*w* are attached to the crankshaft 7 on a side opposite from the crank pin 7*p* so as to balance inertia forces of the pistons 8 of the banks B1 and B2. Therefore, as is well known, the inertia force at the top dead center and bottom dead center of the piston 8 of each of the banks B1 and B2 balances the inertia force of the counterweight 7*w*. Thus, the primary inertia force of the engine E can be balanced without providing a special primary balancer mechanism.

Further, the first and second banks B1 and B2 are disposed so that the cylinder center line A1 of the first bank B1 and the cylinder center line A2 of the second bank B2 pass through the point P which is eccentric from the rotational center A3 of the crankshaft 7 to the side opposite from both the banks B6 and B2. Therefore, the valley portion 11 defined between the first and second banks B1 and B2 can be made large while maintaining the opening angle $\alpha$=90° between the banks B1 and B2. Thus, the valley portion 11 can house the entire carburetor C which is an auxiliary machine of the engine E and a part of the air cleaner Ac with a margin, thereby providing a compact V-type engine E having a small overall height.

In this structure, the carburetor C is of a twin type comprising the horizontal (a direction orthogonal to the crankshaft 7) first and second intake paths 131 and 132 which are disposed in a direction of arrangement of the first and second banks B1 and B2; and the first and second intake paths 131 and 132 individually connected to the intake ports 14 and 14 of the first and second banks B1 and B2 via the pair of conduit paths 17 and 18. Therefore, the intake interference between the banks B1 and B2 is avoided, and the intake resistance is minimized, thereby improving the output performance of the engine E.

In addition, the pair of conduit paths 17 and 18 are provided with the common flange 20 at their upstream sides so that the common flange 20 integrally connects them to constitute the intake manifold 16. Therefore, the common flange 20 is connected to the downstream end of the twin carburetor C, thereby simplifying the structure of the intake system of the V-type engine E to provide an excellent assemblability of the intake system.

Figure 7A:
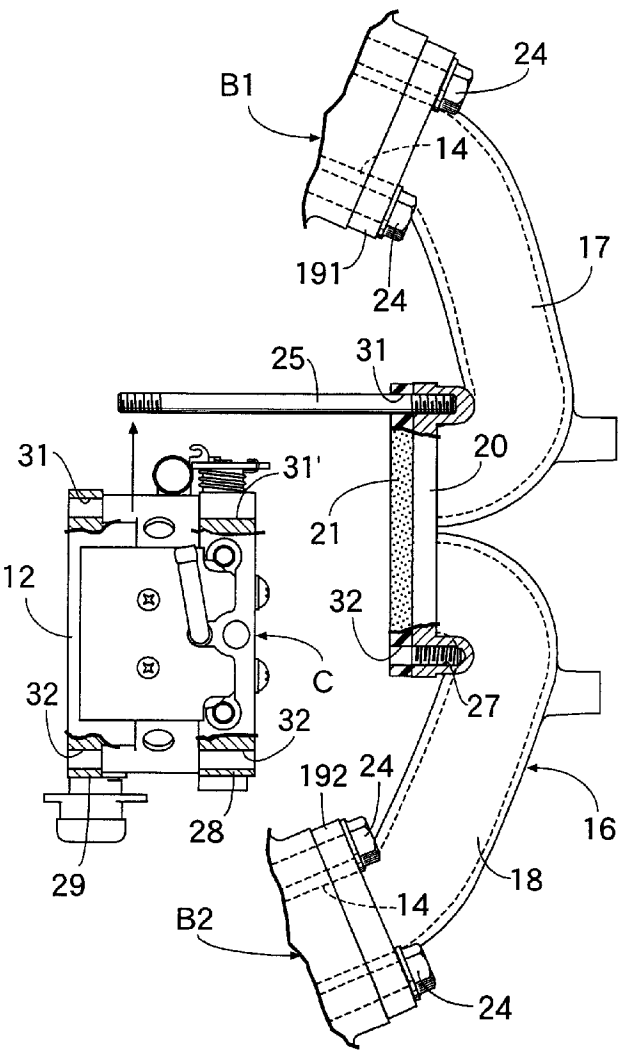
FIG. 7 is a view for explaining a procedure of mounting a carburetor.
Figure 7B:
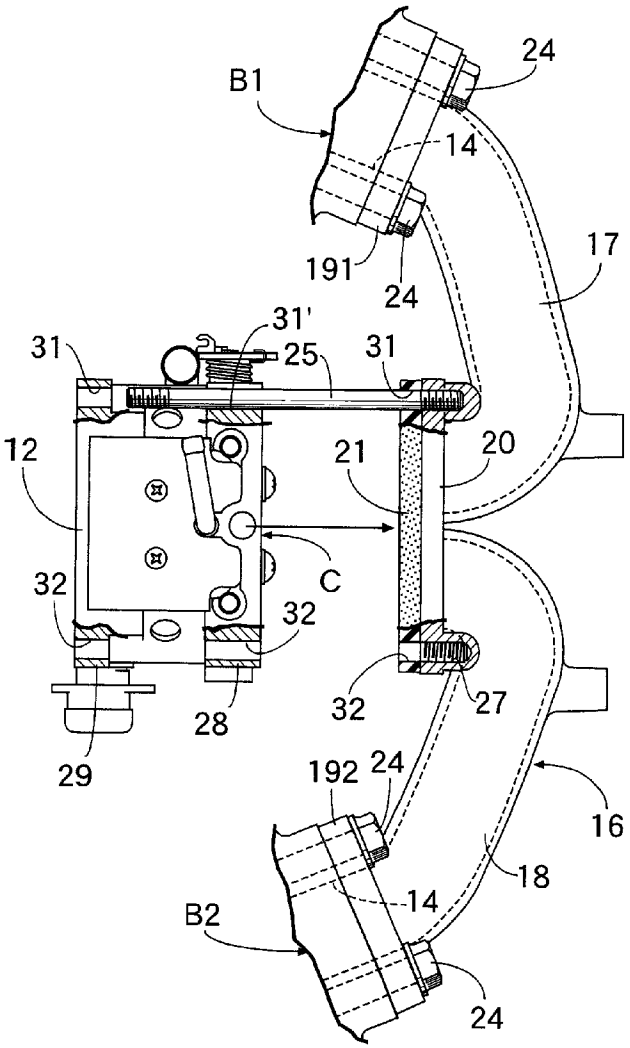

The procedures of mounting the thermally insulating plate 21, the carburetor C and the air cleaner Ac to the common flange 20 of the intake manifold 1 is performed as follows. First, as shown in FIG. 7A, the first bolt holes 31 and 31 of the thermally insulating plate 21 are fitted to the upper and lower stud bolts 25 and 25 vertically provided in the common flange 20. Next, the notched first bolt holes 31' and 31' of the first mounting flange 28 of the carburetor C are engaged with the stud bolts 25 and 25 from their sides (see FIG. 7A). Then, while the entire carburetor C is moved toward the thermally insulating plate 21, the first bolt holes 31 and 31 of the second mounting flange 29 are fitted to the stud bolts 25 and 25 (see FIG. 8). In this procedure, it is possible to set the carburetor C having a relatively large length in the axial direction at a predetermined fitting position with respect to the stud bolts 25 and 25 with a moving amount smaller than the length in the axial direction of the carburetor C, thereby quickly performing the setting of the carburetor C. In addition, even if a space large enough to receive the entire carburetor C does not exist outward of the outer ends of the stud bolts 25 and 25, the carburetor C can be temporarily fixed to the fixed position. In the first embodiment, as shown in FIG. 4, a bulged portion 1*s* of the crankcase 1 exists outward of the outer ends of the stud bolts 25 and 25 due to the existence of the large-diameter follower timing gear 41, and the bulged portion 1*s* interferes with reception of the float chamber 12*a* and the fuel-cutting electromagnetic valve 12*b* of the carburetor C to a space outward of the outer ends of the stud bolts 25 and 25. Therefore, the temporarily fixing structure of the carburetor C to the fixed position without interference of the bulged portion 1*s* is remarkably effective.

Figure 8:
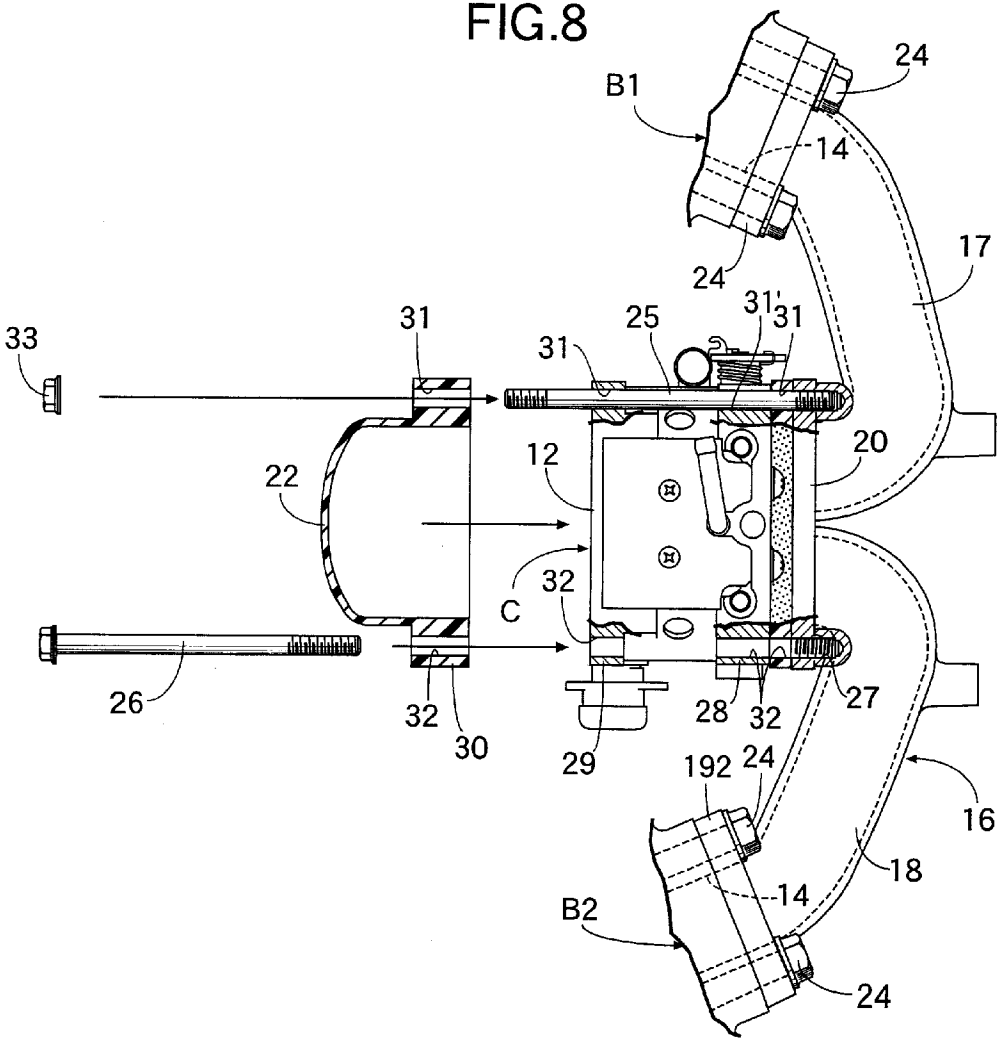
FIG. 8 is a view for explaining a procedure of mounting an air cleaner.

Next, as shown in FIG. 8, the first bolt holes 31 and 31 of the mounting flange 30 of the air cleaner Ac are fitted to the stud bolts 25 and 25; nuts 33 and 33 are finally screwed and fastened to the outer ends of the stud bolts 25 and 25; and the tap bolts 26 and 26 are inserted through all the second bolt holes 32 and 32 to be screwed and fastened into the screw holes 27 and 27 of the common flange 20. In the process of insertion of the tap bolt 26 into the second bolt hole 32, the tap bolt 26 needs to be moved over a distance equal to or larger than the entire length of the carburetor C. However, because the tap bolt 26 is thin, the moving space of the tap bolt 26 can be easily secured in general.

In the above-described structure, the two first bolt holes 31 and 31 of each of the thermally insulating plate 21, the carburetor C and the air cleaner Ac are fitted to the stud bolts 25 and 25, thereby providing a reliable temporary fixed state wherein the rotation of the thermally insulating plate 21, the carburetor C and the air cleaner Ac around the stud bolts 25 and 25 is inhibited. Therefore, the subsequent operation of inserting the tap bolts 26 and 26 into the respective second bolt holes 32 and 32, and operation of screwing the tap bolts 26 and 26 into the screw holes 27 and 27 are facilitated.

Further, by use of the tap bolts 26 and 26 in combination, the carburetor C can be properly fixed in the fixed position without being influenced by the existence of the notched first bolt holes 31' and 31'. Furthermore, the first and second mounting flanges 28 and 29 which are formed at the downstream and upstream ends of the carburetor C are fastened to the common flange 20 by the stud bolts 25 and 25 and the tap bolts 26 and 26, thereby enhancing the mounting strength of the carburetor C.

To dismount the carburetor C and the air cleaner Ac from the common flange 20, the above-described operation procedure is conversely carried out.

In the valve-operating device 37, a pair of intake cam followers 42 and 42 and a pair of exhaust cam followers 43 and 43 include: boss portions 47 swingably supported by the single cam follower shaft 46 which is mounted to the crankcase 1 directly above the camshaft 38 so as to be parallel with the camshaft 38; and slipper portions 48 which slide in contact with the corresponding cams 38*i* and 38*e*. In the pair of intake cam followers 42 and 42, their boss portions 47 and 47 are adjacent to each other on the cam follower shaft 46, and the slippers 48 and 48 are opposed to each other with the exhaust cam 38*e* therebetween. Also in the exhaust cam followers 43 and 43, their boss portions 47 and 47 are adjacent to each other on the cam follower shaft 46, and the slippers 48 and 48 are opposed to each other with the exhaust cam 38*e* therebetween. Therefore, the intake and exhaust cams 38*i* and 38*e* and the pair of intake cam followers 42 and 42 and the pair of exhaust cam followers 43 and 43 can be concentratedly compactly disposed, thereby contributing to reduction in the size of the engine E.

The decompressing device 70 comprising the steel decompressing member 66 mounted to one side surface of the camshaft 38 via the pivot 65 is compact with a simple structure, thereby contributing to reduction in the size of the engine E.

Figure 10:
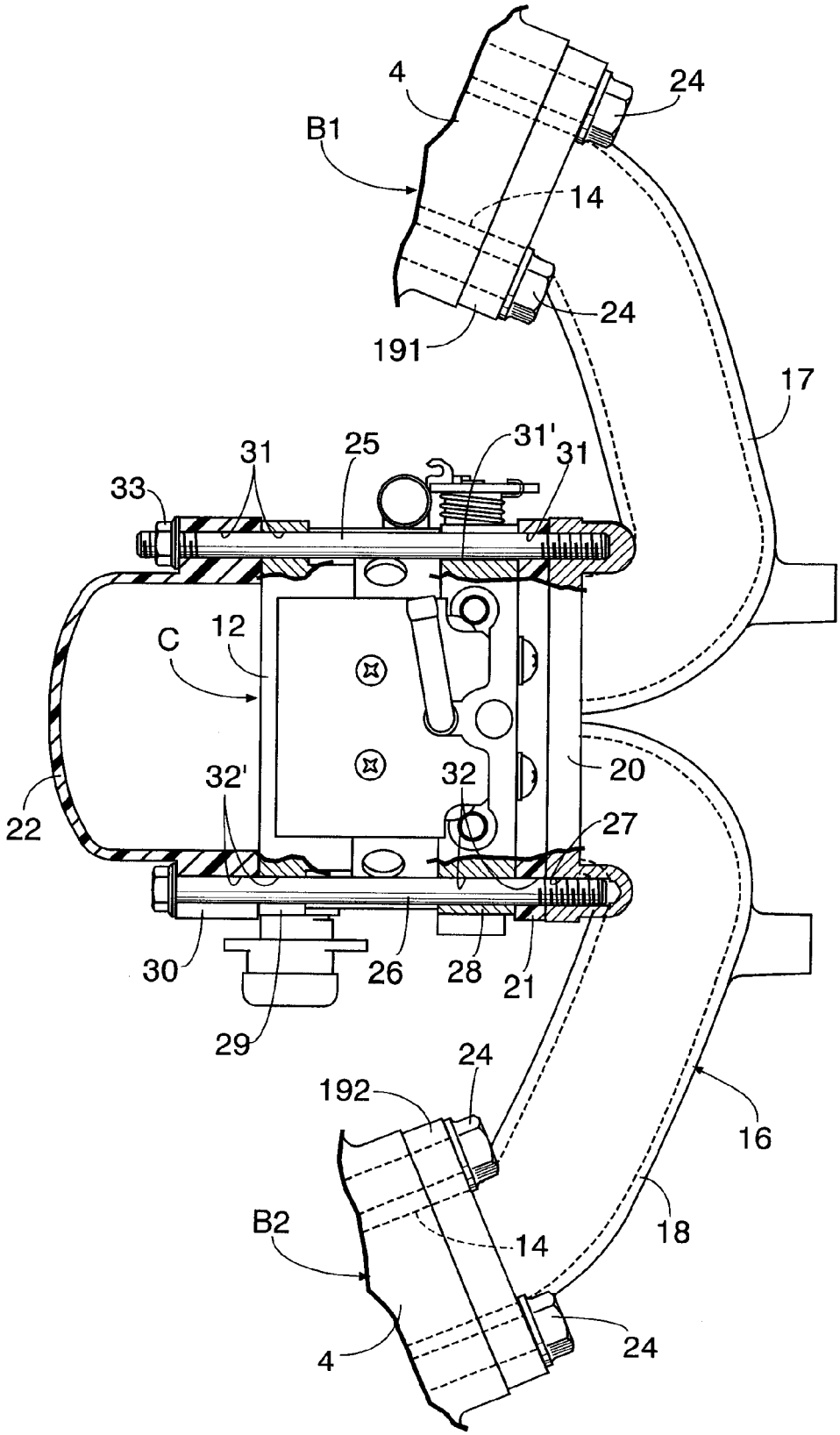
FIG. 10 is a view corresponding to FIG. 5 and showing a second embodiment of the present invention.

Next, a second embodiment of the present invention shown in FIG. 10 will be described.

The second embodiment has the same structure as that of the firsts embodiment except that second bolt holes 32', through which the tap bolt 26 passes, of the mounting flange 29 of the carburetor C and the mounting flange 30 of the air cleaner Ac are each formed into a notched shape as in the case of the first bolt holes 31' of the first embodiment. In FIG. 10, the parts corresponding to those of the first embodiment are denoted by the same reference numerals and symbols, and an overlapping description will be omitted.

The procedure of temporarily fixing the carburetor C in the second embodiment is the same as that in the first embodiment. However, in the second embodiment, at the time of subsequent attaching of the tap bolt 26, the tap bolt 26 is inserted into the notched second bolt hole 32' from its side, thereby reducing the moving amount of the tap bolt 26 in the axial direction to facilitate the attachment of the tap bolt 26 in the narrow space.

The embodiments of the present invention have been described above, but various changes in design may be made without departing from the subject matter of the present invention.

What is claimed is:

1. A carburetor mounting structure comprising:

a first mounting flange and a second mounting flange which are formed at a downstream end and an upstream end of a carburetor, respectively; and a plurality of bolts which pass through the first mounting flange and the second mounting flange and which are fastened to secure them to a carburetor mounting portion of an engine, wherein a stud bolt of said plurality of bolts is implanted in the carburetor mounting portion, and a screw hole is provided in the carburetor mounting portion;

wherein the first mounting flange includes a first bolt hole defined therein and the second mounting flange includes a first bolt defined therein, wherein the stud bolt passes through the first bolt holes of the first and second mounting flanges, wherein the first mounting flange includes a second bolt hole define therein and the second mounting flange includes a second bolt hole defined therein, wherein a tap bolt of said plurality of bolts is screwed into the second bolt holes of the first and second mounting flanges; and wherein the first bolt hole of the first mounting flange is formed into a notched shape, the stud bolt being inserted into the first bolt holes of the first and second mounting flanges from outside of the first mounting flange, and wherein a thermal insulating plate is disposed directly between the first mounting flange and the carburetor mounting portion of the engine.

2. The carburetor mounting structure according to claim 1, wherein at least two stud bolts are disposed on one side portions of the first and second mounting flanges.

3. The carburetor mounting structure according to claim 1 or 2, wherein the engine is of a V-type engine comprising a common crankcase, and first and second banks which respectively have cylinder bores and which are connected to the common crankcase; a common flange serving as the carburetor mounting portion is formed at an upstream end of an intake manifold which is connected to the first and second banks so that the common flange faces a valley portion defined between the first and second banks; and the carburetor is housed in the valley portion and is fastened to the common flange by the stud bolt and the tap bolt.

* * * * *